US006435572B1

(12) United States Patent
Ticu et al.

(10) Patent No.: US 6,435,572 B1
(45) Date of Patent: Aug. 20, 2002

(54) DOUBLE PAWL CONSOLE LATCH

(75) Inventors: Loc B. Ticu, Exton; Gerry Clisham, West Chester, both of PA (US)

(73) Assignee: Southco, Inc., Concordville, PA (US)

( * ) Notice: Subject to any disclaimer, the term of this patent is extended or adjusted under 35 U.S.C. 154(b) by 0 days.

(21) Appl. No.: 09/512,706

(22) Filed: Feb. 25, 2000

Related U.S. Application Data

(60) Provisional application No. 60/121,375, filed on Feb. 25, 1999.

(51) Int. Cl.[7] ..... E05C 1/10

(52) U.S. Cl. ..... 292/175; 292/116; 292/156

(58) Field of Search ..... 292/116, 117, 292/10, 27, 28, 31, 37, 38, 42, 164, 173, 175, 156, 118, 120

(56) References Cited

U.S. PATENT DOCUMENTS 1,179,712 A * 4/1916 Fournier ..... 292/156
1,286,026 A * 11/1918 Koleszar ..... 70/355
1,580,666 A * 4/1926 Hansen ..... 292/128
3,177,033 A * 4/1965 Daniels ..... 296/37
4,500,120 A * 2/1985 Ridgewell ..... 292/19
4,662,664 A * 5/1987 Wendt ..... 292/19
5,149,152 A * 9/1992 Lanius ..... 292/37
5,671,958 A * 9/1997 Szapucki ..... 292/175

* cited by examiner

*Primary Examiner*—Gary Estremsky
(74) *Attorney, Agent, or Firm*—Paul & Paul

(57) ABSTRACT

A console latch for securing a first console closure panel to a first compartment bin and for securing the first compartment bin to a second compartment bin, the latch including a double pawl member with pawl latching elements on each end thereof, and an actuation button for actuating the latch, a locking member being carried on the housing and selectively positionable between a first position which permits actuation of the pawl and a second position which prevents actuation of the pawl. The actuating member including a living spring element which returns the member to its original position after it has been depressed for actuation, and the double pawl member including a spring feature.

7 Claims, 8 Drawing Sheets

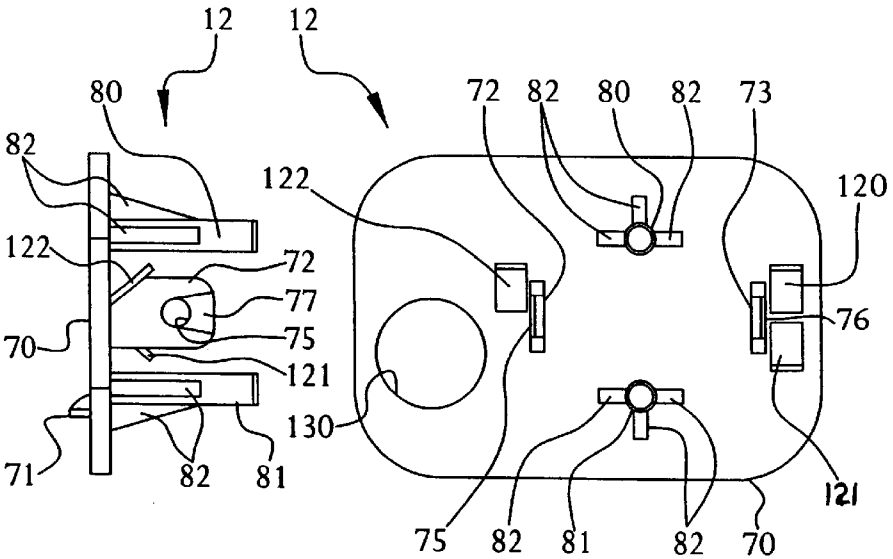
FIG. 9
FIG. 8
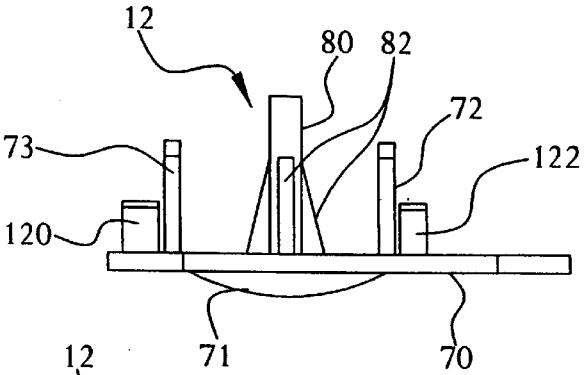
FIG. 10
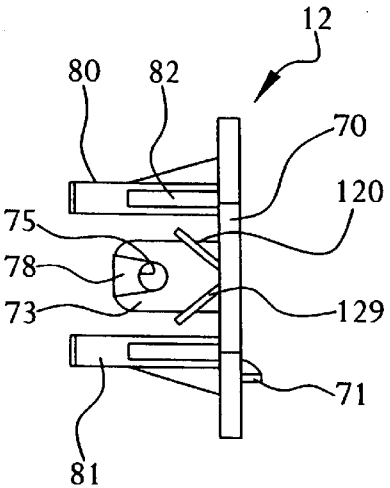
FIG. 7

DOUBLE PAWL CONSOLE LATCH

CROSS REFERENCE TO RELATED APPLICATIONS

This application claims the benefit of U.S. Provisional Patent Application, No. 60/121,375 Filed Feb. 25, 1999.

BACKGROUND OF THE INVENTION

1. Field of Invention

The present invention relates to a latch assembly and more particularly to console latches where an actuation member is depressed to release the latch.

2. Brief Description of the Prior Art

Console latches are generally used to secure the cover of a compartment such as, for example, a console in a vehicle. Often, a console consists of a container, which is swingably hinged between passenger seats to swing out of the way when the vehicle operator or passenger desires. Often, the consoles can store objects therein such as loose change, sunglasses, maps, pens, paper and other articles, which the driver and/or passengers may find it necessary to use. In addition, some consoles also include cup holders, which may be integrally molded therein or can comprise a foldout member, which can be unfolded to form a cup-holding device.

It is desirable to maintain the console cover in a closed position to secure contents therein when the vehicle is being operated. In some instances, it is also desirable to lift the console from a horizontal position to a vertical position and have the console lid and container body move together so that the contents are secured inside. It is known to provide a depressible latching device, which can secure a console lid to the console body and be opened as the vehicle operator or passenger desires by depression of a latch button There are, however, consoles, which employ more complex configurations than simple a cover and console body. The console, its cover and body themselves, may also operate as a unit to cover yet another compartment body which can store additional articles. In such an arrangement, often the second container compartment is merely covered by the adjacent positioning of the console cover and first console compartment, which swing into and out of position to cover the contents. However, it is often desirable to lock both the console cover and first console compartment, as well as the first console compartment to a second compartment so that unauthorized access can be prevented. This can be accomplished with a first latch, which will secure the first cover to the first console compartment, and a second latch, which can secure the first console compartment to a second compartment.

A need exists for an improved latch, which can selectively regulate the opening and closing of a first console compartment as well as a second console compartment.

SUMMARY OF THE INVENTION

The present invention provides a novel latch which can secure a closure cover to a first compartment and can secure the first compartment to a second compartment to act as a cover thereof. The latch of the present invention has a housing, which carries a double pawl member for engagement with a keeper, which can be provided in the closure cover and on the second compartment. The keeper may consist of the cover panel or compartment itself An actuation member, such as a handle or button, is connected to the housing and is disposed for depression by an operator to actuate the latch. The actuation with the handle or button moves the pawl rearwardly with respect to the housing and out of engagement with a keeper. The actuation handle is provided to be actuated in two directions, one by depressing the top of the handle and a second by depressing the bottom of the handle. The handle preferably includes a living spring component to facilitate returning of the handle to its original position, once it has been depressed. The first pawl end of the double pawl member can be actuated with the corresponding top portion of the handle and the second pawl member of the double pawl member can be actuated with the lower portion of the handle. A locking member is selectively positionable to prevent deflection of the pawl and maintain the pawl ends in engagement with their respective corresponding keepers. The double pawl member is provided as a flexible or spring member, which permits the double pawl to be mounted on the housing for flexible displacement upon actuation by the handle.

It is an object of the present invention to provide a latch, which is useful for securing dual compartments of a console in a vehicle.

It is another object of the present invention to provide a latch, which includes a living spring pawl member, which can be released from engagement with a keeper by the actuation of an actuation member.

It is another object of the present invention to provide a pawl member, which has a latching element at each end thereof for securing two keepers to regulate access to one or more compartments.

It is another object of the present invention to provide a latch having a locking mechanism, which can selectively be positioned to prevent actuation of the latch.

It is another object of the present invention to provide a console latch, which can be positioned between a dual compartment console for regulating access to one or more compartment bins of a multi-tiered bin.

It is a further object of the present invention to provide a living spring mechanism to return the actuation member to its original position after actuation.

It is a further object of the present invention to provide a locking mechanism, which locks the pawl to prevent disengagement of the first pawl and second pawl end from respective keepers.

BRIEF DESCRIPTION OF THE DRAWINGS

FIG. 7 is a left side elevation view of the actuation member of the latch of FIG. 1.

FIG. 8 is a right side elevation view of the actuation member of the latch of FIG. 1.

FIG. 9 is a rear elevation view of the actuation member shown in FIG. 7.

FIG. 10 is a top plan view of the actuation member shown in FIG. 7.

DETAILED DESCRIPTION OF THE PREFERRED EMBODIMENTS

Figure 1:
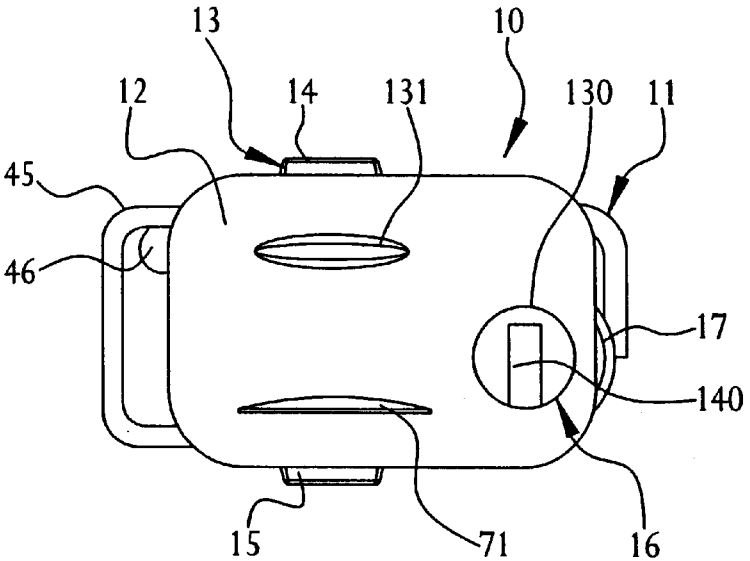
FIG. 1 is a front elevation view of a latch according to the present invention.
Figure 2:
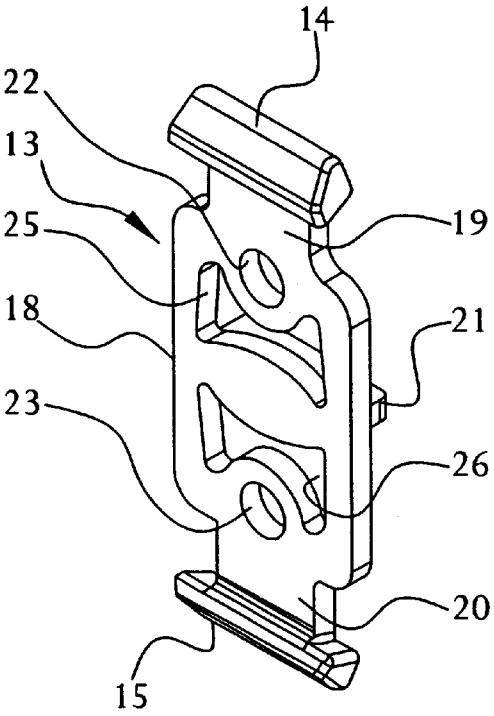
FIG. 2 is a parallel perspective view of the double pawl member of the latch of FIG. 1, as viewed from the front right.

Reference now being made to FIG. 1 where a latch 10 according to the present invention is shown. The latch 10 has a housing 11 and actuation means, shown comprising the handle or actuation button 12 connected to the housing 11. A double pawl member 13 is also provided, having a first pawl end 14 and a second pawl end 15. A locking mechanism is preferably employed with the latch 10 to lock the double pawl member 13 into a secured position to prevent unauthorized opening of the latch 10. The locking means is shown comprising a lock plug 16, which can be any of those suitable, commercially available lock plugs, which can be disposed in a receiving bore 17 of the housing 11. The pawl member 13 is shown, in FIG. 2, having a body portion 18 with a neck 19, 20 disposed on each end thereof, with a pawl engaging end 14, 15, respectively, disposed on each neck 19, 20. The double pawl member 13 is configured to flex at each pawl end thereof when the double pawl member 13 is constrained at the center.

Figure 3:
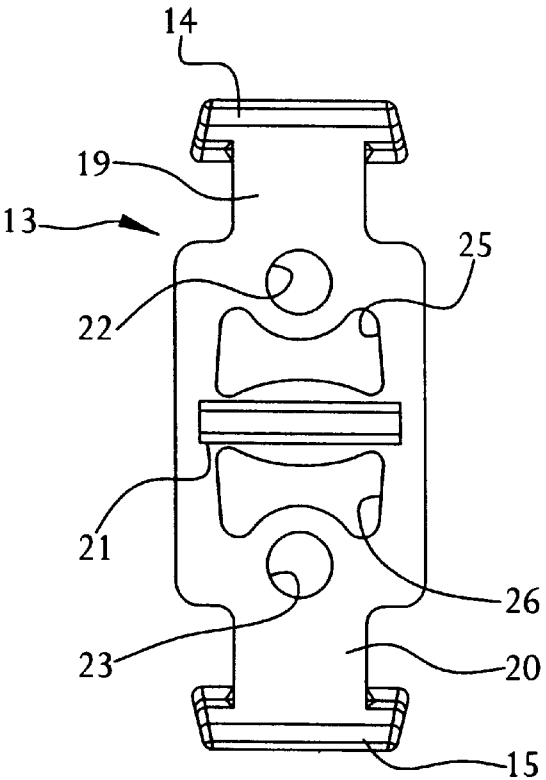
FIG. 3 is a rear elevation view of the double pawl member of FIG. 1.

As shown in FIG. 3, the double pawl member 13 has a connecting tab 21 extending outwardly from the back surface of the body portion 18. The pawl body portion 18 is provided with a first aperture 22 and a second aperture 23 disposed therein. Preferably, the pawl body portion 18 includes a first cutout 25 and a second cutout 26 to facilitate flexing movement of the pawl ends when an actuation force is applied. The pawl member 13 has a connecting tab 21, which is preferably configured for mounting to the housing 11.

Figure 4:
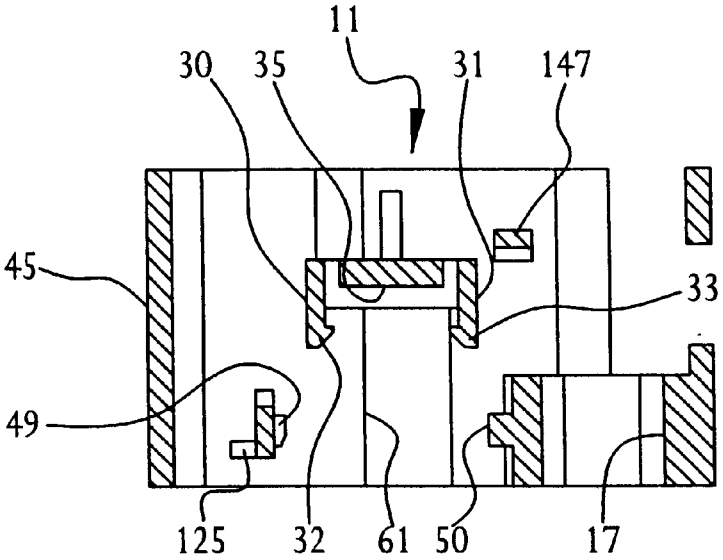
FIG. 4 is a sectional view of the housing of the latch of FIG. 1 taken along the line 4—4 of FIG. 5.

As shown in FIG. 4, the housing 11 includes connecting means for connecting the double pawl member 13 thereto. The connecting means is shown comprising a pair of arms 30, 31, which have barbs, respectively, 32, 33 disposed on an end thereof The housing 11 further has a retaining slot 36, which is disposed between the arms 30, 31. The retaining slot 36 is provided to receive the connecting tab 21. The slot 36 is generally defined by a pair of sidewalls 37, 38.

Figure 5:
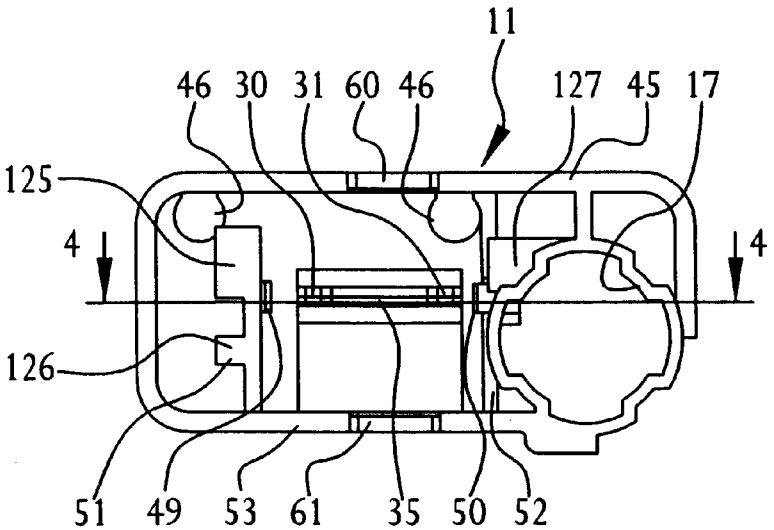
FIG. 5 is a front elevation view of the housing of the latch of FIG. 1.
Figure 6:
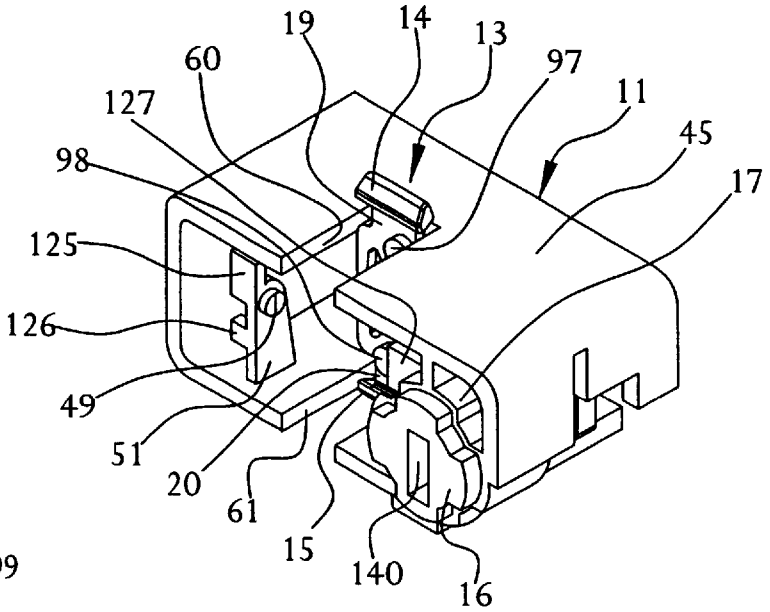
FIG. 6 is a parallel perspective view of the latch according to the present invention, shown without the handle, as viewed from the top right corner.

Referring now to FIG. 5, the housing 11 is shown comprising a body portion 45 with mounting posts 46 disposed thereon. Attachment means for attaching the handle or button 12 to the housing 11 are provided. The attachment means are shown preferably comprising a pair of pintles 49, 50, which are supported on flanges 51, 52, respectively, extending upwardly from the floor 53 of the housing 11. The housing 11 has a sleeve 17 for accommodating a lock plug cylinder 16 (FIG. 6).

As described in connection with FIG. 4, the housing 11 includes retaining arms 30, 31 and a tab 35 which facilitate retention of the double pawl member 13 onto the housing 11. As best shown in FIGS. 5 and 6, the housing 11 has a first slot 60 and a second slot 61 disposed in the housing body 45. Preferably, the first and second slots 60, 61, respectively, are disposed in opposing relation to each other and are configured to accommodate the neck portions 19, 20 of the double pawl member 13 therein.

The actuation means is provided comprising an actuation button or handle 12, which as shown best in the left side view of FIG. 7, comprises a face or actuating surface 70 with a lifting flange 71 disposed along the face 70 and extending outwardly therefrom. Mounting flanges 72, 73 are provided on the rear of the face 70 of the handle 12 and extend outwardly therefrom. Preferably, each mounting flange 72, 73 has an aperture 75, 76, respectively, which are preceded by tapered slot portions 77, 78, respectively, (FIGS. 7 and 8) for facilitating attachment of the handle 12 to the pintles 50, 49, respectively, disposed on the housing 11 (FIG. 5). The handle 12 includes a first post member 80 and a second post member 81 connected to the rear of the face 70 of the handle 12 and extending outwardly therefrom. A plurality of ribs 82 are disposed along each post member 80, 81. The ribs are tapered with the larger dimension starting where the posts 80, 81 meet the face 70 of the handle 12, and the thinner dimension being the end of the rib 82 furthest from the handle face 70.

As shown in FIGS. 7 and 8, the handle 12 further includes means for returning the handle to its original position after it has been depressed. The handle returning means is shown comprising living spring members 120, 121, disposed alongside of the mounting flange 73. The spring elements 120, 121, are preferably living spring elements which are connected at one end to the rear of the face 70 of the handle 12 for movement relative thereto when compressed by an engaging stop 125 located on the housing 11 (FIG. 5). A lower stop 126 is also shown provided on the housing 11 for engagement with the lower spring element 121. The spring elements 120, 121, when engaged with the stops 125, 126, respectively, are moved rearwardly toward the handle face 70, and thereafter, returned to their original positions (as shown in FIG. 7) to position the handle 12 in its original position after actuation. Similarly, as shown in FIG. 8, the spring element 122 is provided adjacent the mounting flange 72. The spring element 122 is provided to function similar to those spring elements 120, 121, described above. As shown in FIG. 5, the housing includes a third stop 127, which the spring element 122 engages when the actuation button or handle 12 is depressed.

As shown in FIGS. 1 and 9, the handle 12 includes an aperture 130 to permit access to the lock plug 16. As shown in FIG. 10, the spring elements 120, 122 (the lower spring element 121 being hidden under the upper spring element 120) are shown extending rearwardly from the handle face 70. Preferably, the handle 12 can also comprise a cored out carrier to permit gripping, such as the recessed 131, shown in FIG. 1.

Figure 11:
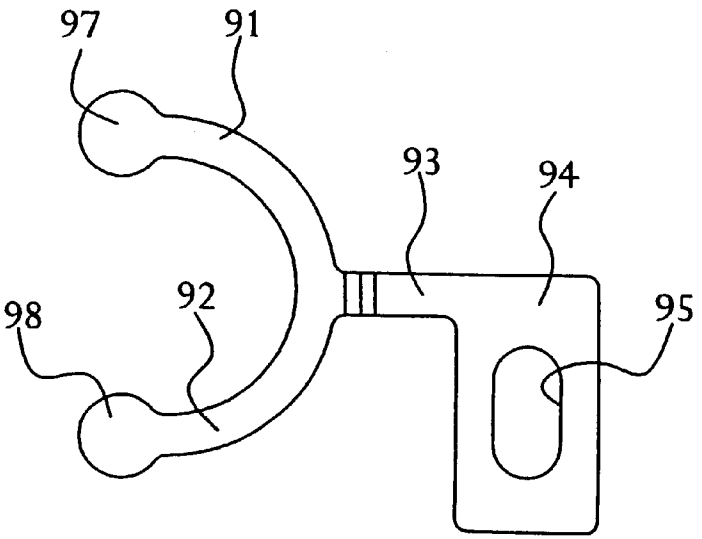
FIG. 11 is a front elevation plan view of the locking member of the latch of FIG. 1.

Reference now being made to FIG. 11, wherein a locking member 90 is provided having a generally "Y" shaped configuration formed by a first arm 91, a second arm 92, a leg 93 and a tab portion 94. The tab portion 94 is provided with a slot 95 disposed therein. The first arm 91 and second arm 92, respectively, is each provided with a circular element 97, 98 at each end thereof.

Figure 13:
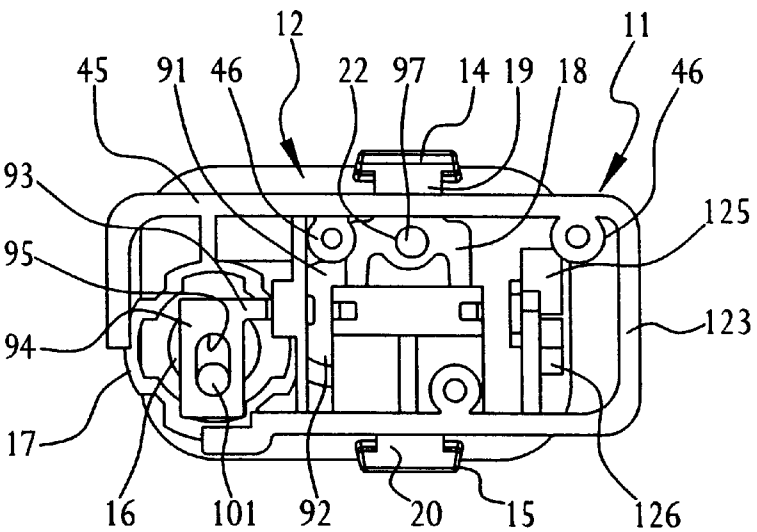
FIG. 13 rear elevation view of the latch of FIG. 1, shown with the locking member in the unlocked position.
Figure 14:
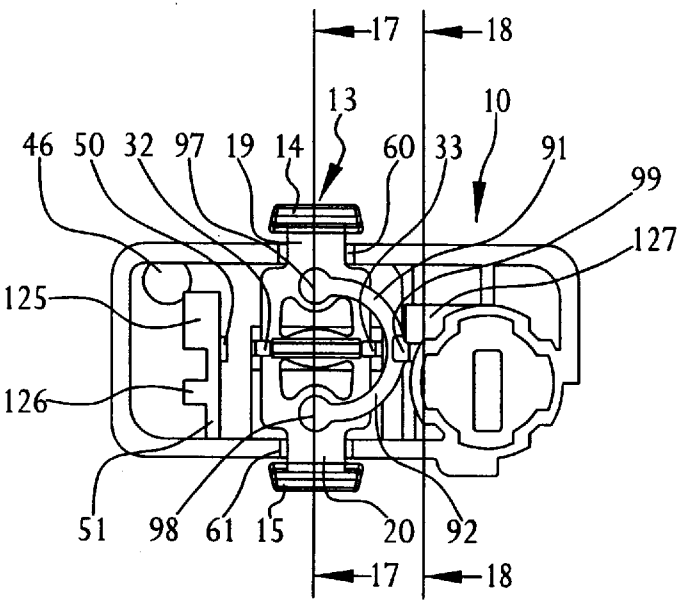
FIG. 14 is a front elevation view of the latch of FIG. 13, shown with the handle removed.
Figure 12:
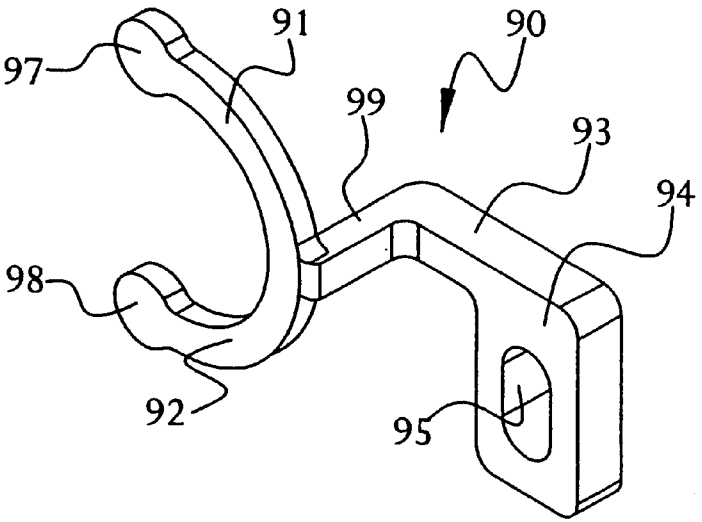
FIG. 12 is a parallel perspective view of the locking member shown in FIG. 9.

Referring to FIG. 12, the first and second arms 91, 92 are shown connected to a connecting member 99, which connects the arms 91, 92 with the leg 93. The locking member 90 is provided for disposition on the housing 11 to align with the first and second apertures 22, 23, respectively of the double pawl member 13, in order to permit actuation of the latch assembly 10. As shown in FIG. 13, the lock plug 16 has a lock pin or post 101 extending rearwardly therefrom and being rotatable over a range of positions with a key (not shown) which can be inserted in the key slot 140 (FIGS. 1 and 6). The post 101 is shown in FIG. 13 in a position at the bottom of the slot 95 of the locking member 90. In the position shown in FIG. 13, the ends 97, 98 of the locking member 90 are positioned over the first and second apertures 22, 23, respectively, of the double pawl member 13, as shown also in the front view of FIG. 14. With the locking member ends 97, 98 in this (FIGS. 13 and 14) position, the handle posts 80, 81 engage the ends 97, 98, respectively, to force the pawl ends 14, 15 of the double pawl 13 rearward to disengage them from corresponding keepers (not shown).

Figure 15:
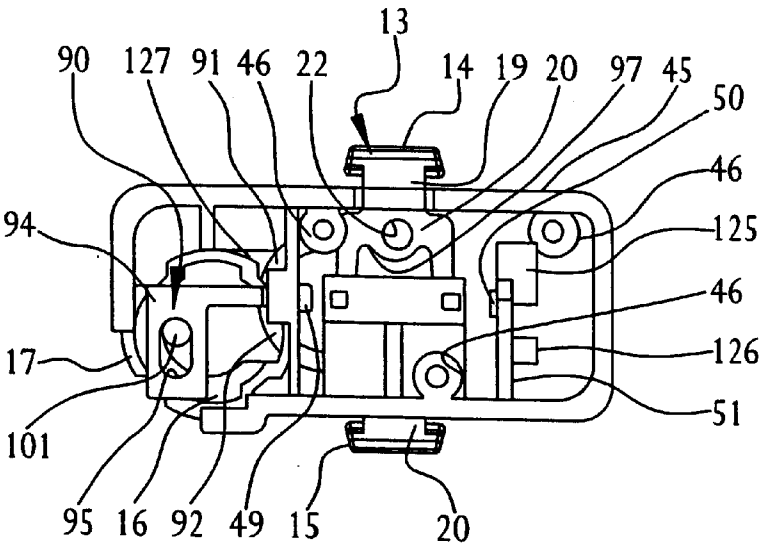
FIG. 15 is a rear elevation view of the latch of FIG. 1, shown with the locking member in the locked position.
Figure 16:
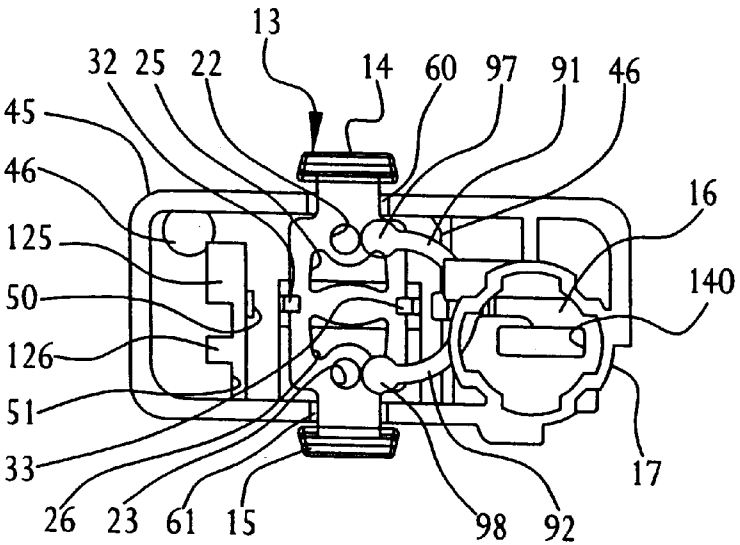
FIG. 16 is a front elevation view of the latch shown in FIG. 15.
Figure 19:
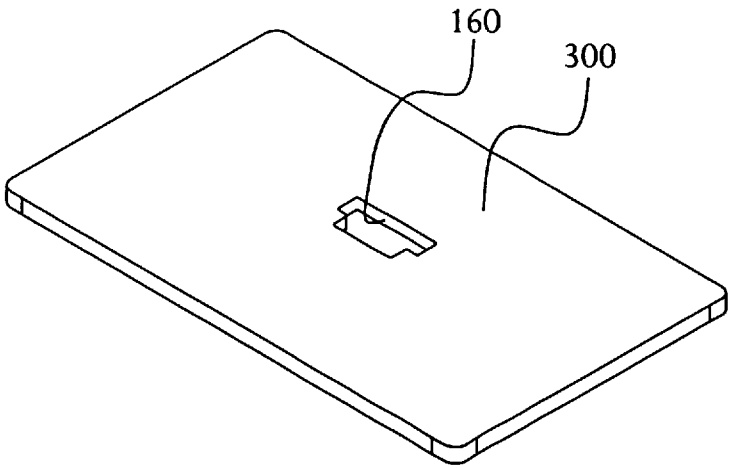
FIG. 19 is a parallel perspective view of a panel with a keeper slot for use in connection with the latch of the present invention.

As shown in FIGS. 15 and 16, the latch 10 is in its locked state, with the locking member 90, shown retracted from alignment with the pawl apertures 22, 23. In this position, the locking member 90 permits the handle posts 80, 81 to pass through the first and second pawl apertures 22, 23, respectively, and no force is transferred to the pawl 13, and the pawl ends 14, 15 remain engaged with a corresponding keeper, such as, for example, the slot 160 disposed in the panel 300, as shown in FIG. 19 (not shown).

Figure 17:
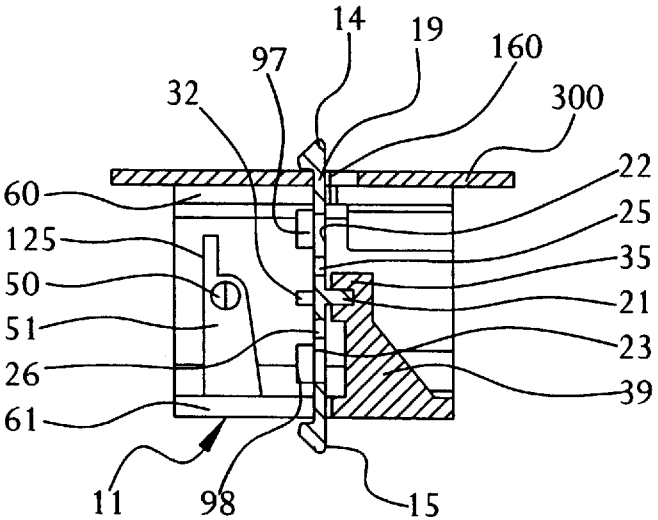
FIG. 17 is a sectional view taken along the line 17—17 of FIG. 14, and showing the first pawl end engaging a keeper, which is provided as a slot of a panel.

FIG. 17 is a sectional view showing the pawl member 13 installed on the housing 11. The pawl connecting tab 21 is received in the slot 35 of the housing arm 39, and is retained by the barbs 32, 33 (FIG. 16).

Figure 18:
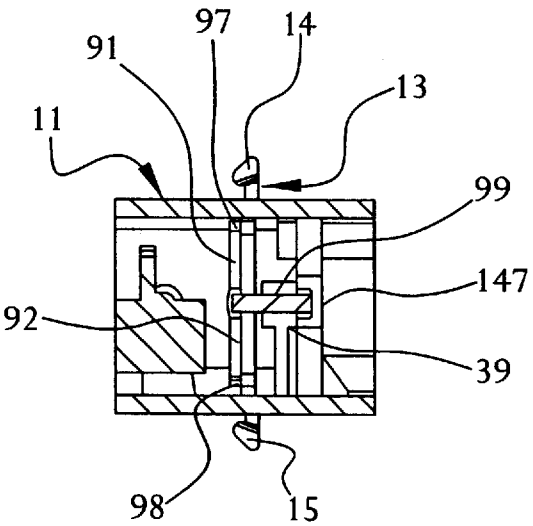
FIG. 18 is a sectional view taken along the line 18—18 of FIG. 14, showing the locking member guide means.

FIGS. 4 and 18 show the locking member guide 147 provided on the housing 11 to guide the locking member leg 93, and support it thereon.

These and other advantages of the present invention will be understood upon a reading of the Summary of the Invention, the Brief Description of the Drawing Figures and the Detailed Description of the Preferred Embodiment. Other modifications may be made consistent with the spirit and scope of the invention described herein.

What is claimed is:

1. A double pawl console latch comprising:

a) a housing;

b) a handle secured within said housing, said handle reciprocating between a latched position and an unlatched position;

c) a double pawl member fixably secured to said housing, said double pawl member being dimensioned and configured to engage a locking member, said double pawl member reciprocating between a latched position and unlatched position; said double pawl member further comprising a connecting tab for mounting to said housing; and d) means for biasing said handle in said latched position, wherein said means for biasing said handle in said latched position is a lifting flange, at least two mounting flanges, and at least two slot portions.

2. The double pawl console latch according to claim 1, wherein said housing further comprises:

a) a body portion; wherein said body portion further comprises at least two retention slots;

b) a retaining slot;

c) means for connecting said double pawl member thereto; wherein said means for connecting said double pawl member thereto comprising at least two arms, wherein said arms comprises barbs;

d) means for attaching said handle to said housing, said means for attaching said handle to said housing comprising at least two pintles, wherein said pintles are supported on at least two flanges, wherein said flanges extend upwardly from a floor of said body portion of said housing.

3. The double pawl console latch according to claim 1, wherein said handle further comprises at least two post members and a plurality of ribs.

4. The double pawl console latch according to claim 1, wherein said means for biasing said handle in said latched position comprises at least three spring members.

5. The double pawl console latch according to claim 1, wherein said locking member comprises a first arm, a second arm, a leg, and a tab portion, wherein said tab portion further comprises a slot.

6. The double pawl console latch according to claim 5, wherein said locking member is dimensioned and configured to accept a post, wherein said post is rigidly connected to a lock pin.

7. The double pawl console latch according to claim 1, wherein said double pawl member being dimensioned and configured to engage a keeper.

* * * * *